US011446925B2

(12) United States Patent
Olbrich et al.

(10) Patent No.: US 11,446,925 B2
(45) Date of Patent: Sep. 20, 2022

(54) FLUID SUPPLY CONTROL

(71) Applicant: HEWLETT-PACKARD DEVELOPMENT COMPANY, L.P., Spring, TX (US)

(72) Inventors: Craig Olbrich, Corvallis, OR (US); Joseph M Torgerson, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/483,088

(22) PCT Filed: Apr. 6, 2017

(86) PCT No.: PCT/US2017/026295
§ 371 (c)(1),
(2) Date: Aug. 2, 2019

(87) PCT Pub. No.: WO2018/186861
PCT Pub. Date: Oct. 11, 2018

(65) Prior Publication Data

US 2020/0016892 A1 Jan. 16, 2020

(51) Int. Cl.
*B41J 2/045* (2006.01)
*B41J 2/14* (2006.01)
*B41J 2/175* (2006.01)

(52) U.S. Cl.
CPC ..... *B41J 2/04563* (2013.01); *B41J 2/0458* (2013.01); *B41J 2/14153* (2013.01);
(Continued)

(58) Field of Classification Search
CPC ..... B41J 2/04563; B41J 2/1408; B41J 2/175; B41J 2/04528
See application file for complete search history.

(56) References Cited

U.S. PATENT DOCUMENTS 4,860,027 A 8/1989 Ozelis et al.
4,896,172 A * 1/1990 Nozawa ..... B41J 2/1408 347/17
(Continued)

FOREIGN PATENT DOCUMENTS

EP 0482850 A2 4/1992
JP 61-266250 A 11/1986
(Continued)

OTHER PUBLICATIONS

Kwon, et al. Inkjet jet failures and their detection using piezo self sensing. Sensors and Actuators A 201 pp. 335-341. ScienceDirect.
(Continued)

*Primary Examiner* — Lam S Nguyen
(74) *Attorney, Agent, or Firm* — HP Inc. Patent Department

(57) ABSTRACT

Examples include a fluid ejection system. The fluid ejection system comprises a fluid supply reservoir, a fluid ejection die, a fluid delivery subsystem, and a control engine. The fluid ejection die comprises nozzles to eject fluid and at least one temperature sensor disposed on the die to sense a temperature of the fluid ejection die. The fluid delivery subsystem fluidly connects the fluid reservoir and the fluid ejection die, and the fluid delivery subsystem comprises at least one valve to regulate conveyance of fluid from the fluid supply reservoir to the fluid ejection die. The control engine controls the at least one valve to thereby regulate conveyance of fluid from the fluid supply reservoir to the fluid ejection die based at least in part on the temperature of the fluid ejection die.

2 Claims, 10 Drawing Sheets

(52) U.S. Cl.
CPC ..... *B41J 2/175* (2013.01); *B41J 2202/12* (2013.01); *B41J 2202/13* (2013.01)

(56) References Cited

U.S. PATENT DOCUMENTS

| | | | | |
|---|---|---|---|---|
| 6,231,167 | B1 | 5/2001 | Tsuboi et al. | |
| 6,322,189 | B1 * | 11/2001 | Anderson | B41J 2/04528 347/17 |
| 6,460,964 | B2 | 10/2002 | Osborne | |
| 6,634,731 | B2 | 10/2003 | Kao et al. | |
| 6,827,416 | B2 | 12/2004 | Matsumoto | |
| 6,866,359 | B2 | 3/2005 | Pan et al. | |
| 7,125,110 | B2 | 10/2006 | Merz et al. | |
| 7,490,919 | B2 | 2/2009 | Combs et al. | |
| 7,699,425 | B2 * | 4/2010 | Tanaka | B41J 2/17566 347/17 |
| 8,091,993 | B2 | 1/2012 | Gilson et al. | |
| 8,226,188 | B2 | 7/2012 | Nishimura | |
| 8,474,937 | B2 | 7/2013 | Jeong et al. | |
| 8,506,063 | B2 | 8/2013 | Limb et al. | |
| 8,628,160 | B2 | 1/2014 | Takano et al. | |
| 9,475,304 | B2 | 10/2016 | Sugitani et al. | |
| 2001/0012031 | A1 | 8/2001 | Miyake et al. | |
| 2002/0113852 | A1 * | 8/2002 | Kimura | B41J 2/17513 347/85 |
| 2003/0202073 | A1 | 10/2003 | Dowell et al. | |
| 2007/0291066 | A1 | 12/2007 | Takabayashi et al. | |
| 2007/0291069 | A1 | 12/2007 | Shihoh et al. | |
| 2009/0021542 | A1 | 1/2009 | Kanfoush et al. | |
| 2009/0115814 | A1 | 5/2009 | Combs et al. | |
| 2010/0214378 | A1 | 8/2010 | Katoh et al. | |
| 2013/0194335 | A1 | 8/2013 | Nodsu | |
| 2014/0240386 | A1 | 8/2014 | Hagiwara et al. | |
| 2014/0300657 | A1 | 10/2014 | Ike | |
| 2015/0343763 | A1 | 12/2015 | Zhang | |
| 2016/0159089 | A1 | 6/2016 | Kaneko | |
| 2016/0214378 | A1 | 7/2016 | Yoshida et al. | |

FOREIGN PATENT DOCUMENTS

| | | |
|---|---|---|
| JP | 02-162054 A | 6/1990 |
| RU | 2207958 | 7/2003 |
| RU | 2007114584 | 10/2008 |
| WO | WO-2015080709 | 6/2015 |

OTHER PUBLICATIONS

Cibis, et al. Influencing Parameters in Droplet Formation for DoD Printing of Conductive Inks. Apr. 21-24, 2008. Institute of Automation Technology. Hamburg, Germany.

* cited by examiner

FLUID SUPPLY CONTROL

BACKGROUND

Fluid ejection dies may eject fluid drops via nozzles thereof. Nozzles may include fluid ejectors that may be actuated to thereby cause ejection of drops of fluid through nozzle orifices of the nozzles. Some example fluid ejection dies may be printheads, where the fluid ejected may correspond to ink.

DRAWINGS

Figure 1:
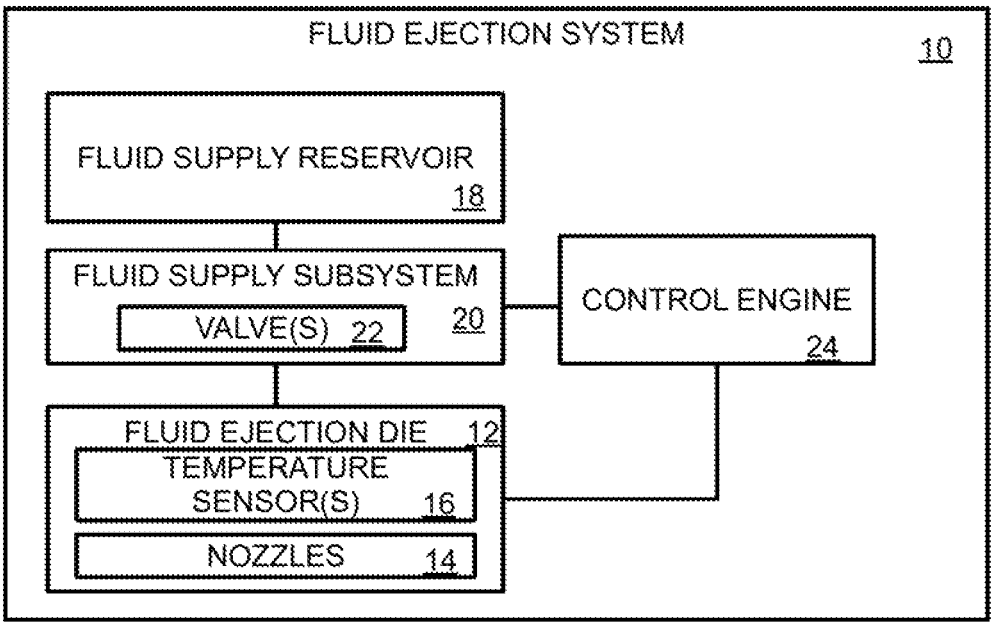
FIG. 1 is a block diagram that illustrates some components of an example fluid ejection system.

Throughout the drawings, identical reference numbers designate similar, but not necessarily identical, elements. The figures are not necessarily to scale, and the size of some parts may be exaggerated to more dearly illustrate the example shown. Moreover the drawings provide examples and/or implementations consistent with the description; however, the description is not limited to the examples and/or implementations provided in the drawings.

DESCRIPTION

Examples of fluid ejection systems may comprise at least one fluid ejection die. Example fluid ejection dies may comprise a plurality of ejection nozzles that may be arranged in a set, where such plurality of nozzles may be referred to as a set of nozzles. In some examples, each nozzle may comprise a fluid chamber, a nozzle orifice, and a fluid ejector. A fluid ejector may include a piezoelectric membrane based actuator, a thermal resistor based actuator (which may be referred to as a thermal fluid ejector), an electrostatic membrane actuator, a mechanical/impact driven membrane actuator, a magneto-strictive drive actuator, or other such elements that may cause displacement of fluid responsive to electrical actuation. Furthermore, example fluid ejection dies may comprise at least one temperature sensor disposed thereon. In some examples, a fluid ejection die may comprise at least two temperature sensors disposed at different positions of the fluid ejection die.

In such examples, for a respective nozzle, an actuation signal may be transmitted to the respective nozzle to cause actuation of a fluid ejector disposed in the respective nozzle. Due to actuation of the fluid ejector, the nozzle may eject a drop of fluid. As used herein, an ejection event may refer to the actuation and subsequent ejection of at least one fluid drop from at least one nozzle. Moreover, it may be noted that in some examples, a plurality of nozzles may be actuated concurrently such that a plurality of fluid drops may be ejected concurrently. Accordingly, in these examples, an ejection event refers to the concurrent actuation and ejection of fluid drops from a plurality of respective nozzles.

Furthermore, some example fluid ejection systems may comprise at least one fluid reservoir and a fluid supply subsystem (also referred to herein as a fluid delivery subsystem) coupled to the at least one fluid reservoir and the at least one fluid ejection die. In such examples, fluid may be stored in the at least one fluid reservoir and conveyed to the at least one fluid ejection die via the fluid supply subsystem. The fluid supply subsystem may comprise at least one valve, where the valve may be adjusted to thereby regulate flow of fluid from the at least one reservoir to the at least one fluid ejection die. Example types of valves that may be included in example fluid supply subsystems may comprise gate valves, ball valves, diaphragm valves, butterfly valves, needle valves, globe valves, check valves, and/or other such similar types of valves.

In some example fluid ejection systems, as fluid is ejected via nozzles, a temperature change may occur. For example, if fluid ejectors of the nozzles correspond to thermal fluid ejectors, a temperature of a fluid ejection die may increase responsive to actuation of the thermal fluid ejector. In addition, when fluid drops are ejected from the nozzle, a temperature decrease/cooling effect may occur. Accordingly, an ejection event for a fluid ejection die may facilitate a temperature change of the fluid ejection die. In addition, a volume of, fluid ejected for a particular nozzle (i.e., a size of a fluid drop) may correspond to the cooling effect achieved by the ejection action. In turn, a size of a fluid drop ejected via a nozzle may correspond to a fluid flow and associated backpressure of fluid from the fluid reservoir to the fluid ejection die.

Moreover, example fluid ejection systems may include a control engine, where the control engine may control the at least one valve to thereby regulate conveyance of fluid from the at least one fluid supply reservoir to the at least one fluid ejection die based at least in part on a temperature of the fluid ejection die. In such examples, by controlling the at least one valve based at least in part on a temperature of the fluid ejection die, such examples may thereby regulate a flow and backpressure of fluid conveyed to the fluid ejection die to thereby regulate a size of fluid drops ejected from the fluid ejection die. As such, examples may facilitate fluid ejection drop size monitoring and regulation for fluid ejection dies.

As shown herein, example fluid ejection systems may comprise engines, where such engines may be any combination of hardware and programming to implement the functionalities of the respective engines. In some examples described herein, the combinations of hardware and programming may be implemented in a number of different ways. For example, the programming for the engines may be processor executable instructions stored on a non-transitory machine-readable storage medium and the hardware for the engines may include a processing resource to process and execute those instructions.

In some examples, a fluid ejection system implementing such engines may include the machine-readable storage medium storing the instructions and the processing resource to process the instructions, or the machine-readable storage medium may be separately stored and accessible by the system and the processing resource. In some examples, engines may be implemented in circuitry. Moreover, processing resources used to implement engines may comprise a processing unit (CPU), an application specific integrated circuit (ASIC), a specialized controller, and/or other such types of logical components that may be implemented for data processing.

Some examples contemplated herein may compare temperatures and/or temperature changes of a fluid ejection die to an expected temperature or an expected range of temperatures. In such examples, if temperature and/or temperature changes of a fluid ejection die are not within an expected range, examples may adjust components of a fluid supply system in a manner described herein. An expected temperature or an expected temperature range may be predefined by the system, or such expected temperature or expected temperature range may be determined by the system during performance of operations by the system. For example, a fluid ejection system may monitor temperature of a fluid ejection die during ejection of fluid drops with the fluid ejection die for a set of 10 ejection events. Based on previous performances of the set of 10 ejection events, the fluid ejection system may have an expected range of temperature changes that occur for the fluid ejection die when performing the 10 ejection events. In other examples, a fluid ejection system may have an expected temperature change range for a given duration when performing ejection events, such as one minute. In such examples, the fluid ejection system may compare a measured temperature change over one minute to the expected temperature change range. These and other similar examples are contemplated herein.

Turning now to the figures, and particularly to FIG. 1, this figure provides a block diagram that illustrates some components of an example fluid ejection system 10. As shown, the fluid ejection die may comprise at least one fluid ejection die 12. The at least one fluid ejection die 12 may comprise nozzles 14 and at least one temperature sensor 16. Furthermore, the example fluid ejection system 10 may comprise a fluid reservoir 18 fluidly connected to a fluid supply subsystem 20. The fluid supply subsystem 20 comprises at least one valve 22, and the fluid supply subsystem is fluidly connected to the fluid ejection die 12. Therefore, as discussed previously, the fluid supply reservoir may store fluid, such fluid may be conveyed to the fluid ejection die 12 for ejection with the nozzles 14 thereof via the fluid supply subsystem 20. The at least one valve 22 of the fluid supply subsystem may be adjustable to thereby adjust and regulate conveyance of fluid from the fluid supply reservoir 18 to the fluid ejection die 12.

As shown, the fluid ejection system 10 further comprises a control engine 24. The control engine 24 may be coupled to the fluid supply subsystem 20 and the fluid ejection die 12. As described previously, the control engine 24 may monitor temperature of the fluid ejection die 12 during ejection events, and the control engine 24 may control the at least one valve 22 of the fluid supply subsystem based at least in part on the temperature of the fluid ejection die 12.

Figure 2:
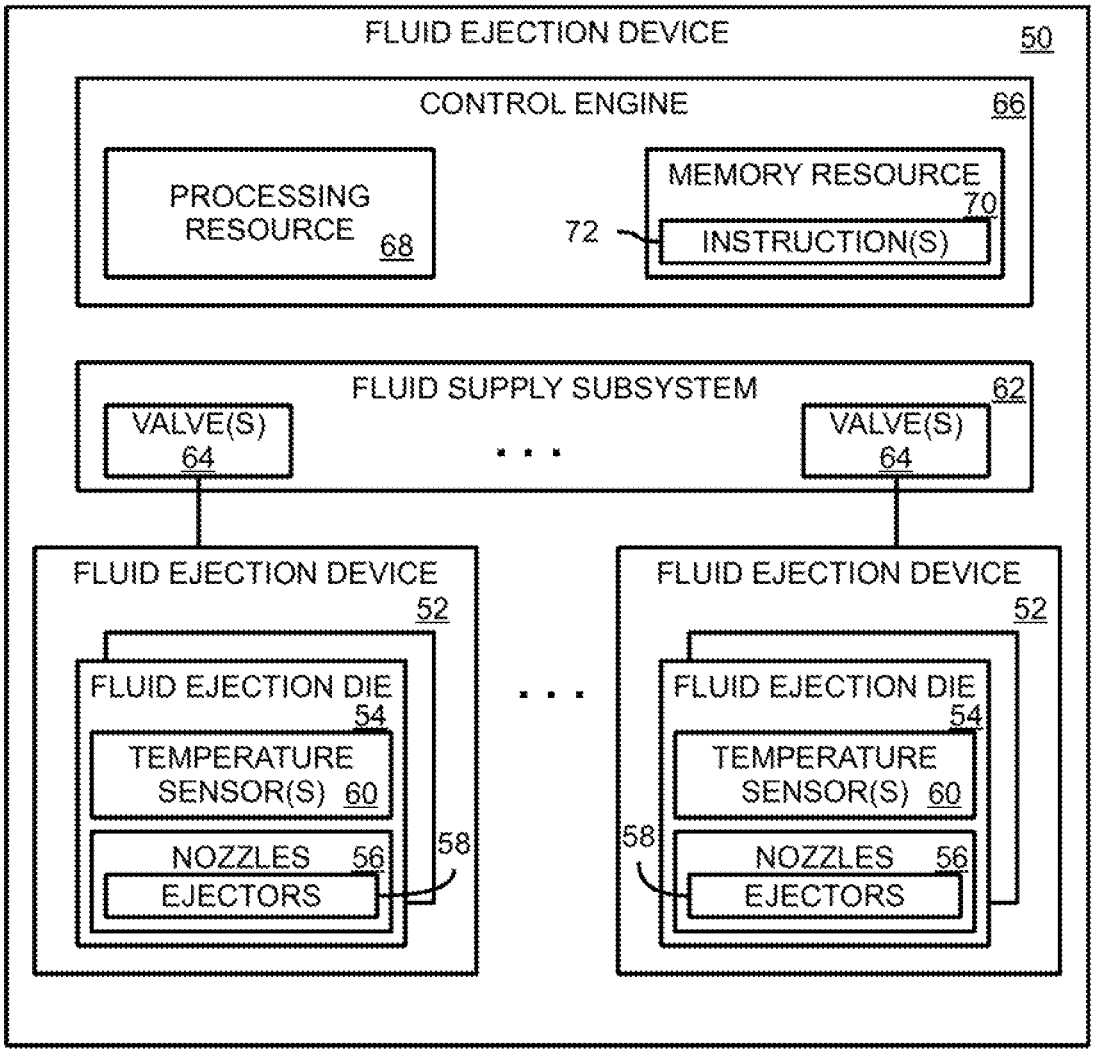
FIG. 2 is a block diagram that illustrates some components of an example fluid ejection system.

FIG. 2 provides a block diagram that illustrates some components of an example fluid ejection system 50. In this example, the fluid ejection system 50 may comprise at least one fluid ejection device 52. Each fluid ejection device 52 may comprise at least one fluid ejection die 54. Each fluid ejection die 54 comprises nozzles 56 with fluid ejectors 58 disposed therein, and the fluid ejection die 54 further comprises and at least one temperature sensor 60. In the example of FIG. 2, the fluid ejection system 50 includes a fluid supply subsystem 62 comprising, at least one respective valve 84 for each respective fluid ejection device 52. As shown, the at, least one respective valve 64 is fluidly connected to the respective fluid ejection device 52 such that conveyance of fluid from the fluid supply subsystem 62 to the fluid ejection devices 52 (and the fluid ejection dies thereof 54) may be regulated/controlled by the valves 64.

While not illustrated in this example, the fluid supply subsystem may be fluidly coupled to a fluid reservoir. In particular, a fluid reservoir may be replaceable, such that a fluid reservoir in which ail fluid has been used may be replaced with another fluid reservoir. In such examples, a replaceable fluid reservoir may be removably coupled to the fluid supply subsystem 62 such that fluid may be conveyed from the fluid reservoir to the fluid ejection devices 52 via the fluid supply subsystem 62. As described in previous examples, the fluid ejection system 50 further comprises a control engine 66. As shown, the control engine may comprise at least one processing resource 68 and at least one memory resource 70 that stores executable instructions 72. Execution of instructions 72 may cause the processing resource 68 and/or fluid ejection system 50 to perform functionalities, processes, and/or sequences of operations described herein. Notably, the memory resource 70 may be non-transitory.

The control engine 66 may monitor temperature of fluid ejection dies 54 of the fluid ejection devices 52 with the temperature sensors 60 thereof. Based at least in part on a temperature of the fluid ejection dies 54 associated with at least one ejection event, a temperature change of the fluid ejection dies 54 associated with at least one ejection event, and/or a rate of temperature change of the fluid ejection dies 54 associated with at least one ejection event, the control engine may control the fluid supply subsystem 62 to thereby control conveyance of fluid to the fluid ejection devices 52.

FIGS. 3-10 provide flowcharts that provide example sequences of operations that may be performed by an example fluid ejection system and/or a processing resource thereof to perform example processes and methods. In some examples, the operations included in the flowcharts may be embodied in a memory resource (such as the example memory resource 70 of FIG. 2) in the form of instructions that may be executable by a processing resource to cause the an example fluid ejection system and/or a control engine thereof to, perform the operations corresponding to the instructions. Additionally, the examples provided in FIGS. 3-10 may be embodied in systems, machine-readable storage mediums, processes, and/or methods. In some examples, the example processes and/or methods disclosed in the flowcharts of FIGS. 3-10 may be performed by one or more engines. Moreover, performance of some example operations described herein may include control of components and/or subsystems of the fluid ejection system by a control engine thereof to cause performance of such operations. For example, ejection of fluid drops with a fluid ejection die of the system may include control of the fluid ejection die by the control engine to cause such ejection of fluid drops.

Figure 3:
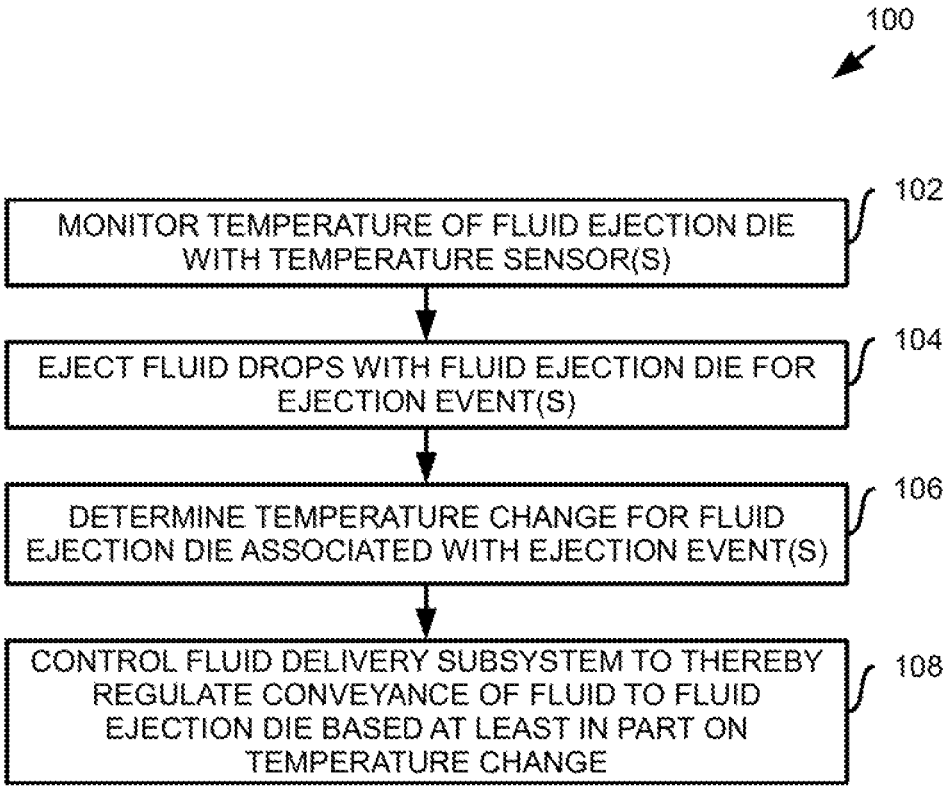
FIG. 3 is a flowchart that illustrates an example sequence of operations that may be performed by an example fluid ejection system.
Figure 4:
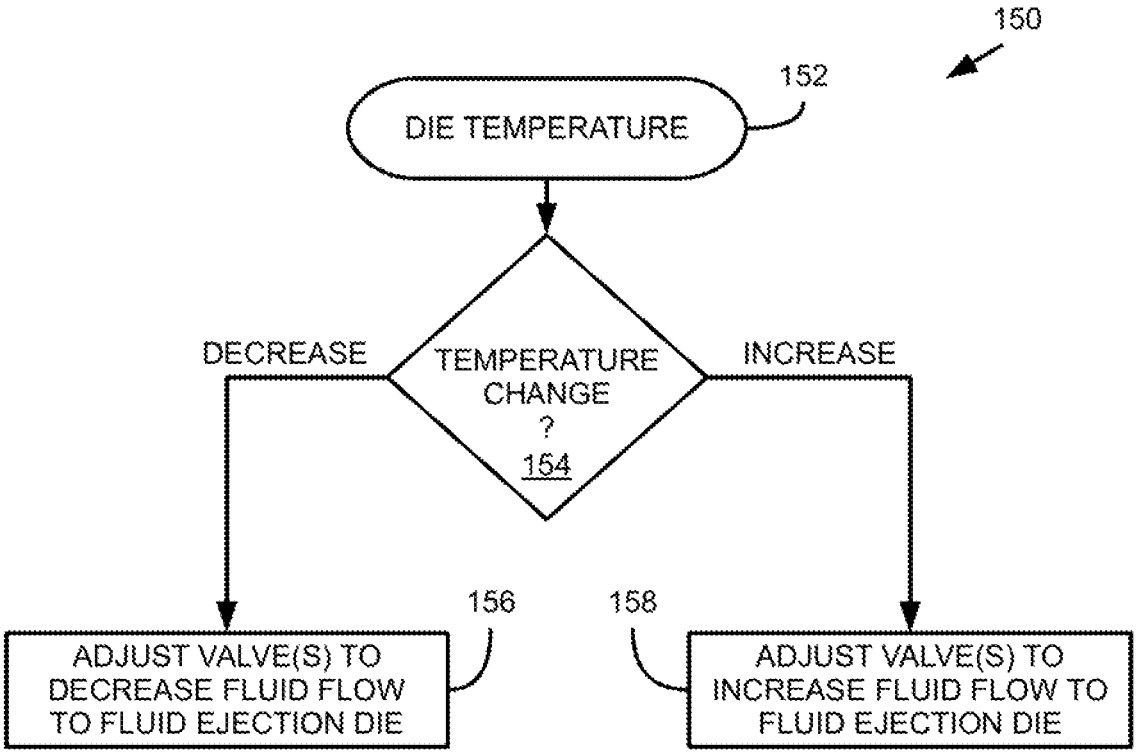
FIG. 4 is a flowchart that illustrates an example sequence of operations that may be performed by an example fluid ejection system.

Turning now to FIG. 3, this figure provides a flowchart 100 that illustrates an example sequence of operations that may be performed by an example fluid ejection system. The fluid ejection system may monitor temperature of a fluid ejection die with at least one temperature sensor disposed on the fluid ejection die (block 102). The fluid ejection system may eject fluid drops with nozzles of the fluid ejection die for at least one fluid ejection event (block 104). A temperature change associated with the at least one ejection event associated with the fluid ejection die may be determined (block 106). Based at least in part on the temperature change of the fluid ejection die, a fluid delivery subsystem of the fluid ejection system may be controlled to thereby regulate conveyance of fluid to the fluid ejection die (block 108), FIG. 4 provides a flowchart 150 that illustrates a sequence of operations that may be performed by an example fluid ejection system. As discussed in previous examples, a fluid ejection system may monitor die temperature associated with ejection events (block 152). In response to a decreasing, temperature change (DECREASE branch of block 154), examples may adjust valves to decrease fluid flow to the fluid ejection die (block 156). In response to an increasing temperature change (INCREASE branch of block 154), example ay adjust valves to increase flow to the fluid ejection die (block) 158).

Figure 5:
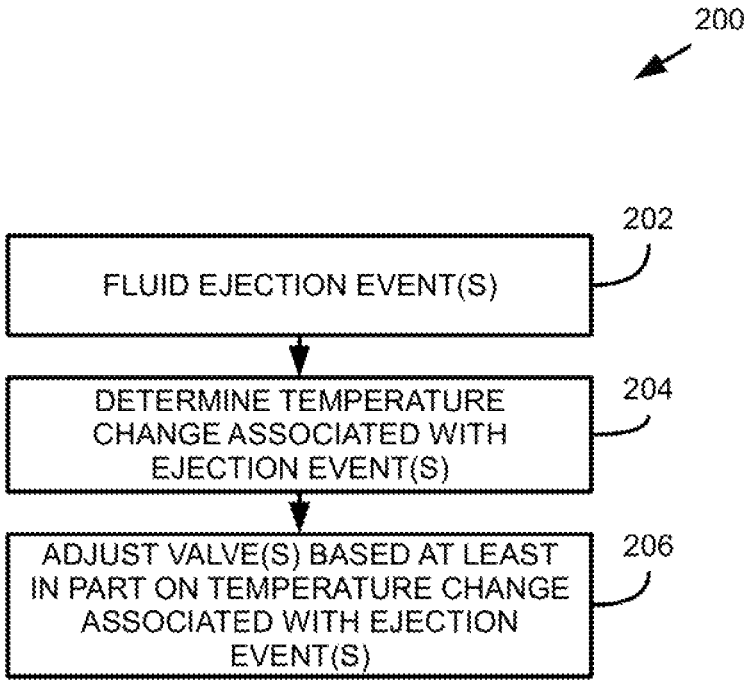
FIG. 5 is a flowchart that illustrates an example sequence of operations that may be performed by an example fluid ejection system.

FIG. 5 provides a flowchart 200 that illustrates a sequence of operations that may be performed by an example fluid ejection system. In particular, the fluid ejection system may eject fluid drops via fluid ejection dies thereof for a fluid ejection event or a plurality of fluid ejection events (block 202). A temperature change associated with the ejection events may be determined (block 204), and at least one valve of the fluid ejection system may be adjusted based at least in part on the temperature change associated with the fluid ejection events (block 206). As used herein, a temperature change of a fluid ejection die may correspond to an absolute temperature change of the die. Furthermore, a temperature change may further include a rate of change of the temperature of the fluid ejection die overtime, in other examples, a temperature change may include a rate of change of the temperature of the fluid ejection die over the number of ejection events.

Figure 6:
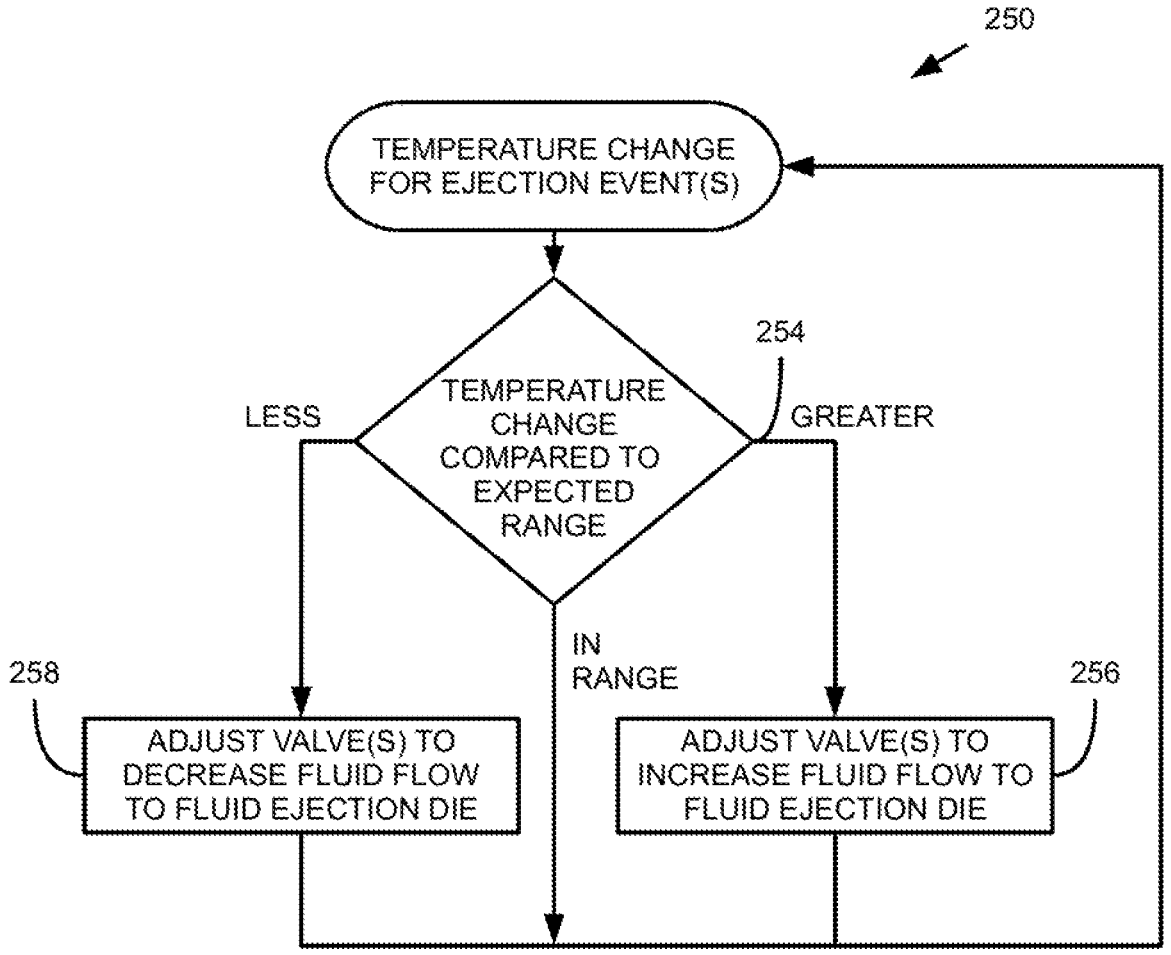
FIG. 6 is a flowchart that illustrates an example sequence of operations that may be performed by an example fluid ejection system.

FIG. 6 provides a flowchart 250 that illustrates a sequence of operations that may be performed by examples contemplated herein. Similar to previous examples, based at least in part on a temperature change for at least one ejection event (block 252), an example fluid ejection system may compare the temperature change to an expected temperature change range (block 254). In some examples, an expected temperature change range may correspond to a range of temperature changes that may occur for at least one fluid ejection event when the fluid ejection the is ejecting a desired/predefined volume of fluid for each fluid drop. Accordingly, in response to the determined temperature change being within an expected range of temperature changes ('IN RANGE' branch of block 254), the example system may continue monitoring temperature of the fluid ejection die during ejection events, and the system may continue monitoring temperature of the fluid ejection die during ejection events and adjusting fluid flow as described herein.

In response to the determined temperature change being greater than the expected range of temperature changes ('GREATER' branch of block 254), the example system may adjust valves of a fluid supply subsystem to increase fluid flow to the fluid ejection die (block 256), and the system may continue monitoring temperature of the fluid ejection die during ejection events and adjusting fluid flow as described herein. For example, if the determined temperature change was Celsius for a given period of time (e.g., the temperature change corresponds to a rate of change), and the expected range of temperature change for the given period of time was approximately 0.2° Celsius to approximately 1° Celsius for the given period of, time, the example system may increase fluid flow to the fluid ejection die. As discussed previously, if a temperature change exceeds an expected range, such occurrence may indicate that the fluid drops ejected by the ejection die are lesser in volume than desired (i.e., a smaller fluid drop size). By increasing flow to the fluid ejection die, the example may reduce backpressure of fluid supplied to the fluid ejection die, which may increase the volume of ejected fluid drops.

In response to the determined temperature change being less than the expected range of temperature changes ('LESS' branch of block 254), the example system may adjust valves of the fluid supply subsystem to decrease fluid flow to the fluid ejection die (block 268), and the system may continue monitoring temperature of the fluid ejection die during ejection events and adjusting fluid flow as described herein. For example, if the determined temperature change was 1° Celsius for a given number of ejection events and the expected range of temperature changes for the given number of ejection events was approximately 1.5 to approximately 2° Celsius, the example system may decrease fluid flow to the fluid ejection die. As discussed previously, if a temperature change is less than an expected range, such occurrence may indicate that the fluid drops ejected by the ejection die are greater in volume than desired (i.e., a larger fluid drop size). By decreasing flow to the fluid ejection die, the example may increase backpressure of fluid supplied to the fluid ejection die, which may decrease the volume of ejected fluid drops. Furthermore, it may be noted that in examples in which additional fluid flow may be required due to increased ejection volumes, some examples may not decrease fluid flow, but rather, such examples may maintain the fluid flow rate.

Figure 7:
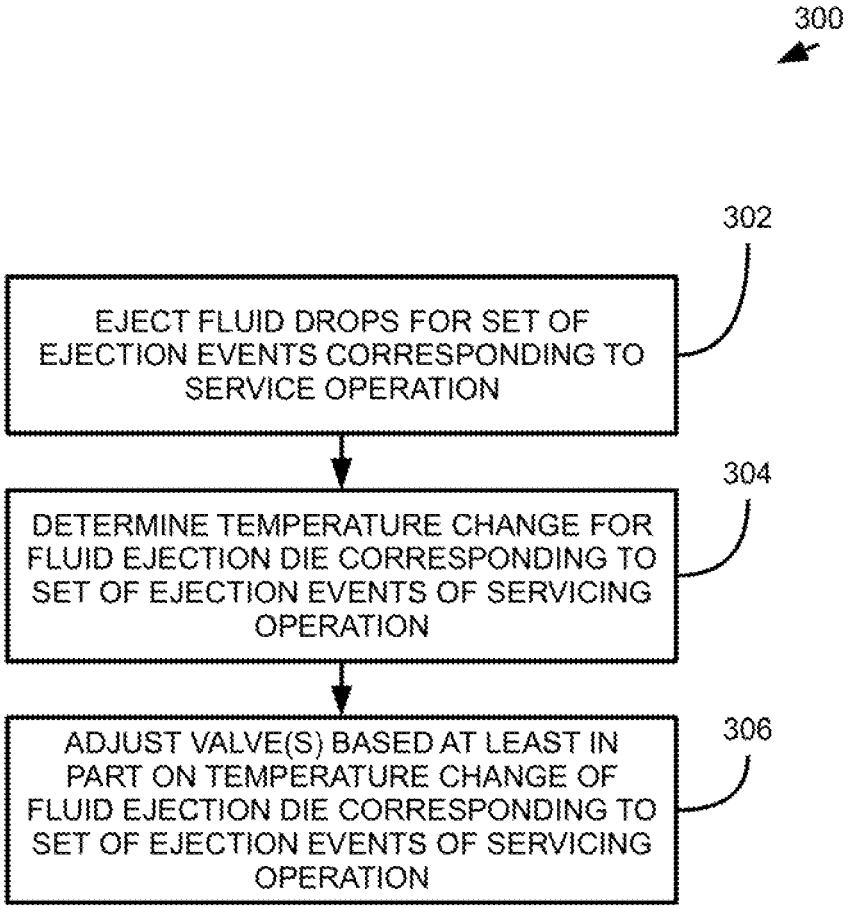
FIG. 7 is a flowchart that illustrates an example sequence of operations that may be performed by an example fluid ejection system.

FIG. 7 provides a flowchart 300 that illustrates a sequence of operations that may be performed by an example fluid ejection system. In some examples, the fluid ejection system may perform servicing operations associated with fluid ejection dies thereof. Some examples of servicing operations include nozzle ejection operations to reduce nozzle clogging, crusting, and/or other, issues that may occur. In such examples, a servicing operation may define particular nozzles to be ejected for a set of ejection events corresponding to the servicing operation. Accordingly, in these examples, the fluid ejection system may eject fluid drops for a set of ejection events corresponding to the servicing operation with a fluid ejection die of the system (block 302). The system may determine a temperature change of the fluid ejection die corresponding to the set of ejection events for the servicing operation (block 304). The fluid ejection system may adjust valves of a fluid supply subsystem of the system to thereby control conveyance of fluid to the fluid ejection die based at least in part on the temperature change corresponding to the set of ejection events of the servicing operation (block 306).

Figure 8:
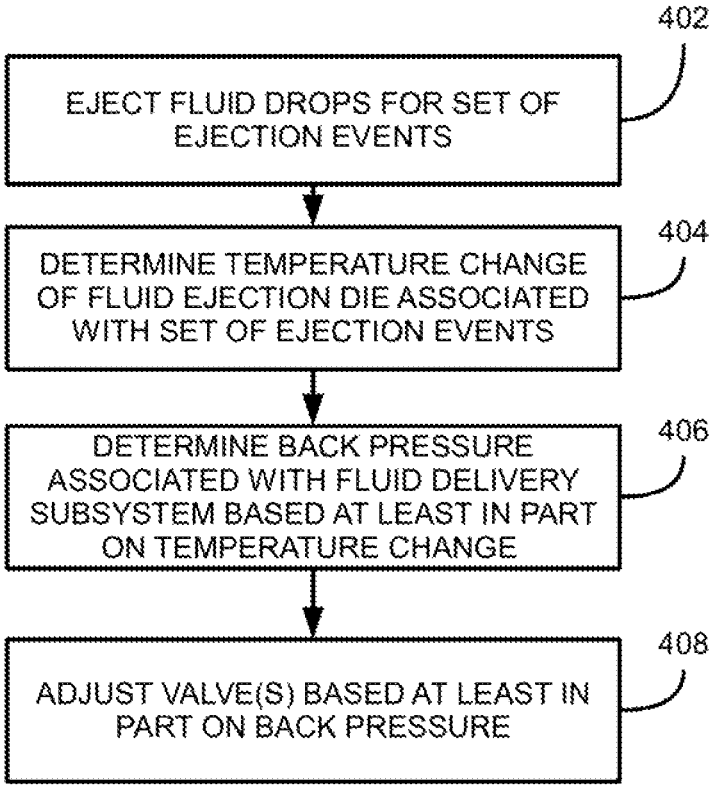
FIG. 8 is a flowchart that illustrates an example sequence of operations that may be performed by an example fluid ejection system.

FIG. 8 provides a flowchart 400 that illustrates a sequence of operations that may be performed by an example fluid ejection system. The fluid ejection system may eject fluid drops with at least one fluid ejection die thereof for a set of ejection events (block 402). The fluid ejection system may determine a temperature change of the fluid ejection die associated with the set of ejection events (block 404). Based on the temperature change, the example system may determine a backpressure associated with a fluid delivery subsystem thereof (block 406), and at least one valve of the fluid ejection system may be adjusted based at least in part on the backpressure (block 408).

Figure 9:
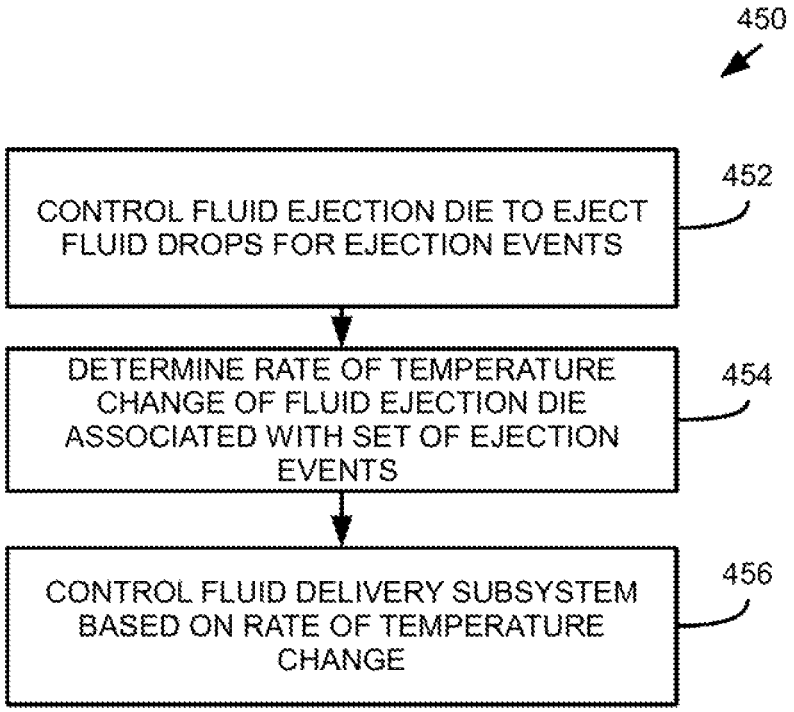
FIG. 9 is a flowchart that illustrates an example sequence of operations that may be performed by an example fluid ejection system.

FIG. 9 provides a flowchart 450 that illustrates an example sequence of operations that may be performed by an example control engine of an example fluid ejection system. The control engine may control a fluid ejection die of the fluid ejection system to eject fluid drops for at least one ejection event (block 452). The example control engine may determine a rate of temperature change of the at least one fluid ejection die associated with the at least one ejection event (block 454). As, discussed previously, a rate of temperature change may correspond to the change in temperature over time. In other examples, the rate of temperature change may correspond to the change in temperature over the number of ejection events. Based on the rate of temperature change, the example control engine may control a fluid delivery subsystem of the fluid ejection system (block 456).

Figure 10:
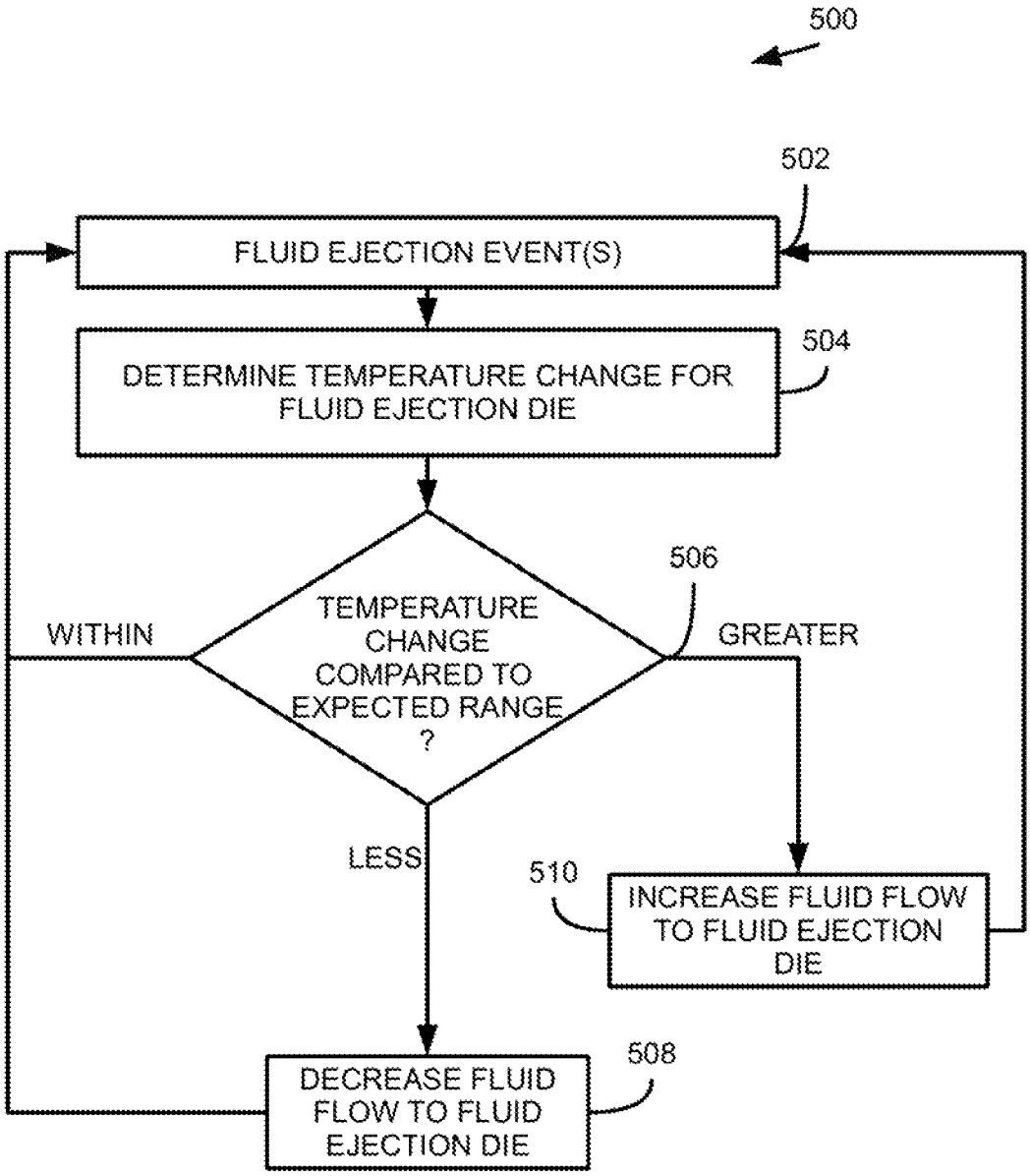
FIG. 10 is a flowchart that illustrates an example sequence of operations that may be performed by an example fluid ejection system.

Turning now to FIG. 10, this figure provides a flowchart 500 that illustrates an example sequence of operations that may be performed by an example fluid ejection system. The fluid ejection system may eject fluid drops with a fluid ejection die thereof for one or a set of fluid ejection events (block 502). The example fluid ejection system may determine a temperature change for the fluid ejection die (block 504) The temperature change may be compared to a range of expected temperature changes (block 506) In response to the temperature change being within the expected range ('WITHIN' branch of block 506), the example system may continue with fluid ejections, monitoring, and analysis of fluid ejection die temperatures. In response to the temperature change being less than an expected range ('LESS' branch of block 506), the example system may decrease fluid flow to the fluid ejection die (block 508). In response to the temperature change being greater than an expected range ('GREATER' branch of block 506), the example system may increase fluid flow to the fluid ejection die (block 510).

Accordingly, examples provided herein may provide a fluid ejection system in which supply of fluid to fluid ejection dies thereof may be controlled based at least in part on temperature of the fluid ejection dies. Moreover, examples described herein may monitor temperature change of fluid ejection dies associated with ejection events. By monitoring temperature and temperature change of fluid ejection dies, examples may determine backpressure of fluid supplied to the fluid ejection dies and/or drop volume of fluid drops ejected by the fluid ejection dies. Therefore, examples described herein may monitor die temperatures and control fluid conveyance with a fluid supply subsystem based on die temperatures to thereby maintain desired drop volumes for ejection.

The preceding description has been presented to illustrate and describe examples of the principles described. This description is not intended to be exhaustive or to limit these principles to any precise form disclosed. Many modifications and variations are possible in light of the description. In addition, while various examples are described herein, elements and/or combinations of elements, may be combined and/or removed for various examples contemplated hereby. For example, the example operations provided herein in the flowcharts of FIGS. 3-10 may be performed sequentially, concurrently, or in a different order. Moreover, some example operations of the flowcharts may be added to other flowcharts, and/or some example operations may be removed from flowcharts. In addition, the components illustrated in the examples of FIGS. 1 and 2 may be added and/or removed from any of the other figures. Therefore, the foregoing examples provided in the figures and described herein should not be construed as limiting of the scope of the disclosure, which is defined in the Claims.

The invention claimed is:

1. A fluid ejection system comprising:

a fluid supply reservoir to store fluid;

a fluid ejection die comprising a plurality of nozzles to eject fluid, the fluid ejection die further comprising at least one temperature sensor disposed thereon to sense a temperature of the fluid ejection die;

a fluid supply subsystem that fluidly connects the fluid supply reservoir and the fluid ejection die, the fluid supply subsystem comprising at least one valve to regulate conveyance of fluid from the fluid supply reservoir to the fluid ejection die; and a control engine to determine a temperature change for the fluid ejection die corresponding to at least one ejection event, and to adjust the at least one valve based at least in part on the temperature change for the fluid ejection die corresponding to the at least one ejection event to thereby regulate conveyance of fluid from the fluid supply reservoir to the fluid ejection die based at least in part on the temperature change of the fluid ejection die;

wherein the control engine is further to:

control the fluid ejection die to eject fluid drops for a set of ejection events;

determine a temperature change of the fluid ejection die associated with the set of ejection events;

determine a back pressure associated with the fluid supply subsystem based at least in part on the temperature change of the fluid ejection die associated with the set of ejection events; and adjust the at least one valve based at least in part on the backpressure associated with the fluid supply subsystem.

2. A method for a fluid ejection system, the method comprising:

monitoring temperature of a fluid ejection die of the fluid ejection system with at least one temperature sensor disposed on the fluid ejection die;

ejecting fluid drops with thermal fluid actuators disposed in nozzles of the fluid ejection die for at least one ejection event;

determining a temperature change of the fluid ejection die associated with the at least one ejection event; and controlling a fluid delivery subsystem to thereby regulate conveyance of fluid to the fluid ejection die based at least in part on the temperature change of the fluid ejection die associated with the at least one ejection event wherein controlling the fluid delivery subsystem to thereby regulate conveyance of fluid to the fluid ejection die based at least in part on the temperature change of the fluid die associated with the at least one ejection event comprises:

in response to the temperature change of the fluid ejection die associated with the at least one ejection event being greater than an expected temperature change, increasing fluid flow to the fluid ejection; and wherein the at least one ejection event comprises a set of ejection events, and the temperature change determined for the fluid ejection die corresponds to a rate of temperature change over time for the set of ejection events.

* * * * *